US005215259A

United States Patent [19]

Wark

[11] Patent Number: 5,215,259

[45] Date of Patent: Jun. 1, 1993

[54] REPLACEABLE INSERT BURNER NOZZLE

[75] Inventor: Rickey E. Wark, Pontiac, Mich.

[73] Assignee: Sure Alloy Steel Corporation, Warren, Mich.

[21] Appl. No.: 744,385

[22] Filed: Aug. 13, 1991

[51] Int. Cl.[5] ..... F23D 13/00

[52] U.S. Cl. ..... 239/587.6; 239/590; 239/591; 239/600; 110/263

[58] Field of Search ..... 239/590, 591, 600, 587.5, 239/587.6; 110/263, 264, 347

[56] References Cited

U.S. PATENT DOCUMENTS

| | | | |
|---|---|---|---|
| 1,922,348 | 8/1933 | Beck | 239/552 X |
| 2,363,875 | 11/1944 | Kreisinger | 122/479 |
| 2,895,435 | 7/1959 | Bogot et al. | 110/28 |
| 3,299,841 | 1/1967 | Hernker et al. | 110/28 |
| 3,823,875 | 7/1974 | Bauer et al. | 239/419.5 |
| 4,185,777 | 1/1980 | Bauer | 239/600 X |
| 4,274,343 | 6/1981 | Kokkinos | 110/263 |
| 4,304,196 | 12/1981 | Chadshay et al. | 122/449 |
| 4,356,975 | 11/1982 | Chadshay et al. | 239/419.5 |
| 4,425,855 | 1/1984 | Chadshay | 110/263 |
| 4,429,644 | 2/1984 | Thomas | 110/245 |
| 4,459,922 | 7/1984 | Chadshay | 110/265 |
| 4,495,874 | 1/1985 | Greskovich et al. | 110/347 |
| 4,501,204 | 2/1985 | McCartney et al. | 110/264 |
| 4,520,739 | 6/1985 | McCartney et al. | 110/263 |
| 4,526,111 | 7/1985 | Mischke | 110/245 |
| 4,596,198 | 6/1986 | Greskovich et al. | 110/347 |
| 4,611,543 | 9/1986 | Collette | 110/347 X |
| 4,627,366 | 12/1986 | LaRue et al. | 110/263 |
| 4,634,054 | 1/1987 | Grusha | 239/423 |
| 4,654,001 | 3/1987 | LaRue | 431/354 |
| 4,685,359 | 8/1987 | Worthen et al. | 76/108.2 |
| 4,836,772 | 6/1989 | LaRue | 431/285 |
| 4,915,619 | 4/1990 | LaRue | 431/284 |

FOREIGN PATENT DOCUMENTS 310555 4/1929 United Kingdom .

*Primary Examiner*—Andres Kashnikow
*Assistant Examiner*—Kevin Weldon
*Attorney, Agent, or Firm*—Krass & Young

[57] ABSTRACT

A vertically aimable tip for a pulverized coal nozzle used in the boiler areas of coal fired, steam generating facilities. The nozzle tip comprises box-like outer and inner housings which are pivotally mounted as a unit to the outlet end of a pulverized coal conduit. A box-like end housing having integral splitter plates is loosely mounted in the outer housing in conforming and contiguous abutting relationship to the inner housing to complete the pulverized coal flow path. An air flow path is defined by the spacing between the outer housing and the combination of the inner and end housings. The combination of the end housing and splitter plates is held in place by means by slots and locking keys or tabs to permit differential thermal expansion. The splitter plates are hardfaced and extend upstream into the interior of the inner housing.

18 Claims, 3 Drawing Sheets

REPLACEABLE INSERT BURNER NOZZLE

INTRODUCTION

This invention resides in the field of projector nozzles for pulverized coal and the like and more particularly to an improved nozzle tip which is designed to resist wear, tolerate high temperatures and be relatively easily replaced in service.

BACKGROUND OF THE INVENTION

Large heavy duty nozzles are typically used to project streams of pulverized coal and air into the fireball area of a combustion chamber in, for example, an electrical generating plant. Four nozzles may be located at respective corners of the combustion chamber to aim the pulverized coal/airstreams tangentially of the fireball. The nozzle tips are typically hingedly connected to the main conduit portion of the nozzle such that the fireball may be raised and lowered within the combustion chamber for temperature control purposes.

The nozzle tip is exposed to an extremely harsh environment in actual operation; i.e., pulverized coal is highly abrasive and the flow thereof through the nozzle rapidly wears portions of the nozzle away. In addition the heat created by the fireball and the high temperature gradients produced by the through flow of air subject the nozzle structure to extreme internal stresses caused by large temperature differentials.

The above-described factors create the need for nozzle tip structures which are more capable of withstanding the harsh environment and which are relatively easily replaced with the minimum of down time, preferably from inside the combustion chamber.

The prior art includes U.S. Pat. No. 4,672,900 issued Jun. 16, 1987 to Richard Santalla et al which illustrates the four cornered tangential firing arrangement described above. With more specific relevance to nozzle tip structures, the prior art further includes U.S. Pat. No. 520,739 issued Jun. 4, 1985 to Michael McCartney et al. disclosing a three-piece nozzle tip comprising a box-like base portion, a box-like temperature resistant end cap and an abrasion resistant cast insert which is adapted to be sandwiched between the base portion and the end cap. The three-piece unit is held together by way of connector bolts. The end cap and the cast insert are individually replaceable.

This unit, although complex, represents a theoretical advantage over the more standard one-piece nozzle tip in which inner and outer rectangular housings are held together in essentially concentric spaced relationship by means of welded ribs. The space between the inner and outer housings defines an air flow path while the interior of the inner housing defines the flow path for the pulverized coal. The inner housing is typically provided with a plurality of parallel baffles hereinafter called "splitter plates" which ensure that the coal is adequately divided as it enters the combustion chamber. This unit is hingedly attached to the outlet end of the nozzle conduit for vertical aiming adjustment as previously described.

Practical experience shows that the one-piece nozzle tip is highly subject to abrasion wear, particularly at the junctions between the splitter plates and the sidewalls of the inner housing. In addition these structures typically exhibit a number of cracks and fractures in the outer housing, the inner housing and the ribs between the housings due to the aforementioned stresses caused by high temperature gradients.

Another prior art patent, U.S. Pat. No. 4,356,975 issued Nov. 2, 1982 to Roman Chadshay, also deals with the problems of rapid wear in the nozzle tip due to the abrasive affects of pulverized coal and the exposure of the nozzle tip to high temperatures. The disclosure of this patent proposes to solve these problems by making the splitter plates in two physically different parts and assembling these parts in the inner shell of the nozzle; i.e., the two portions of each of the splitter plates are arranged in serially abutting relationship such that the edge of one plate portion lies against the edge of another plate portion. The splitter plate portions are aligned by means of rail like members.

SUMMARY OF THE INVENTION

The present invention provides an improved abrasion and temperature resistant nozzle tip comprising two principal portions: a hinged unit consisting of box-like inner and outer housings, the space between which forms an air passage, and a replaceable end housing having one or more splitter plates mounted between the opposing side portions thereof and adapted for simple removable mounting in the end of the hinged unit. In accordance with the invention the end housing splitter plates project rearwardly; i.e., upstream in the coal flow path, into the inner housing of the hinged unit to effectively integrate the units for coal flow purposes. At the same time, the interconnection of the end housing to the outer housing of the hinged unit is non-rigid and non-fixed; i.e., preferably a loose interconnection by means of slots and locking tabs or keys, such that the end housing and the hinged unit housings are permitted to expand and contract relatively independently of one another without creating the thermal stresses that lead to cracks and fractures as described above.

A further feature of the invention is a taper lock fit between the end housing and outer housing, achieved in part by the locking tabs or keys to secure the end housing within the outer housing in a non-rigid but secure fit. In one embodiment the outer housing includes rigid spacers on the inside surface of the bottom portion of the outer housing to receive the end housing and hold it in spaced relationship to the outer housing. The rigid spacers mate with the tapered bottom portion of the end housing to provide an initial taper lock fit upon the axial insertion of the end housing and the outer housing. This greatly facilitates assembly and replacement of the end housing, since the end housing is held securely in place without additional structure when slid into position by a workman. The taper lock fit is further secured by insertion of removable spacers between the top portion of the end housing and the outer housing. Although the removable spacers or keys can additionally be welded to, for example, the outer housing, the taper lock fit makes such a step optional.

As hereinafter revealed in detail, at least portions of the splitter plates are "hardfaced" by means of conventional hardfacing welding techniques. The surfaces covered include all of the leading edge and major plane surfaces in the coal flow path thereby to reduce abrasion wear and the need for frequent replacement.

DETAILED DESCRIPTION OF THE ILLUSTRATIVE EMBODIMENT

Figure 1:
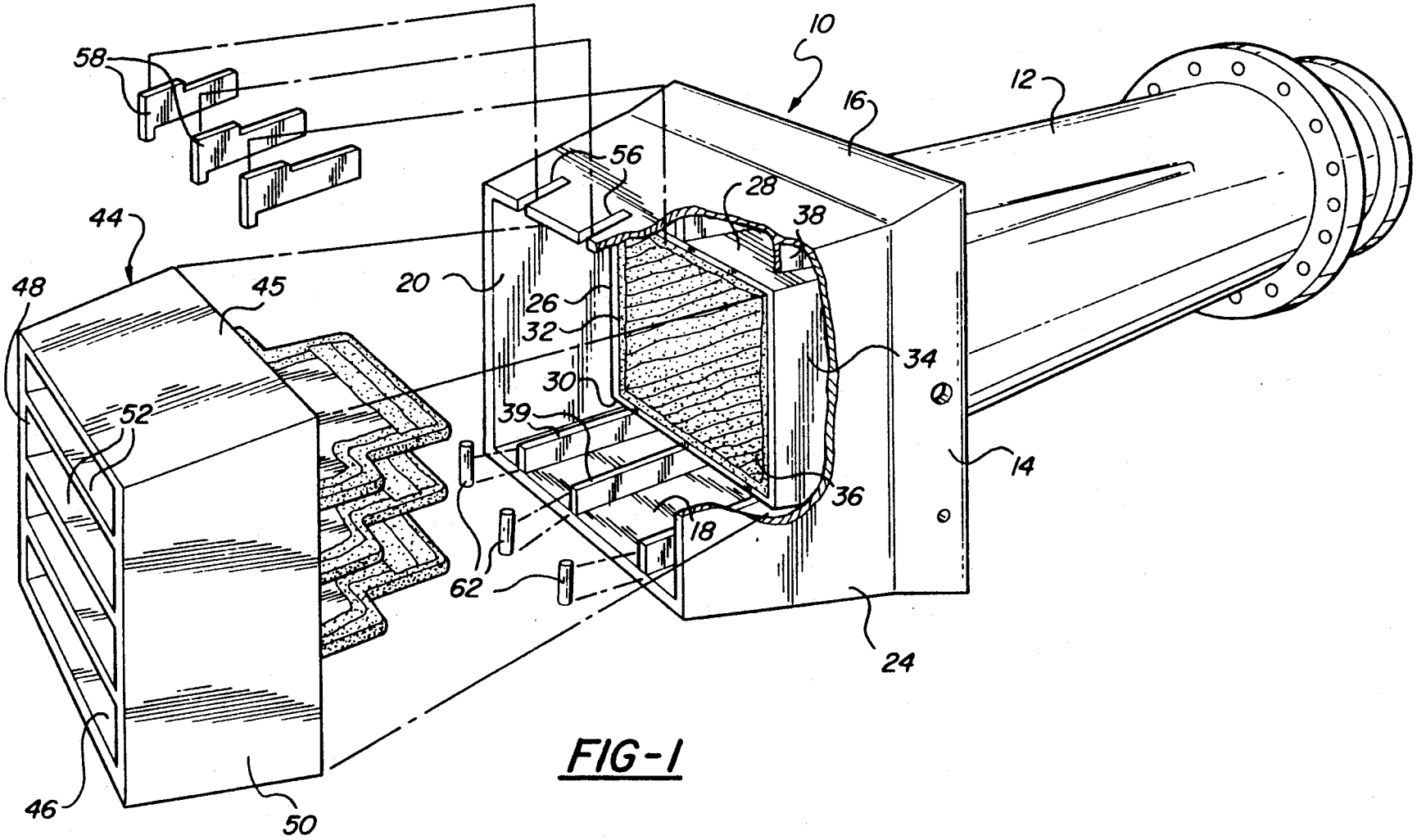
FIG. 1 is a partially exploded perspective view of a first embodiment coal nozzle tip incorporating the invention.
Figure 2:
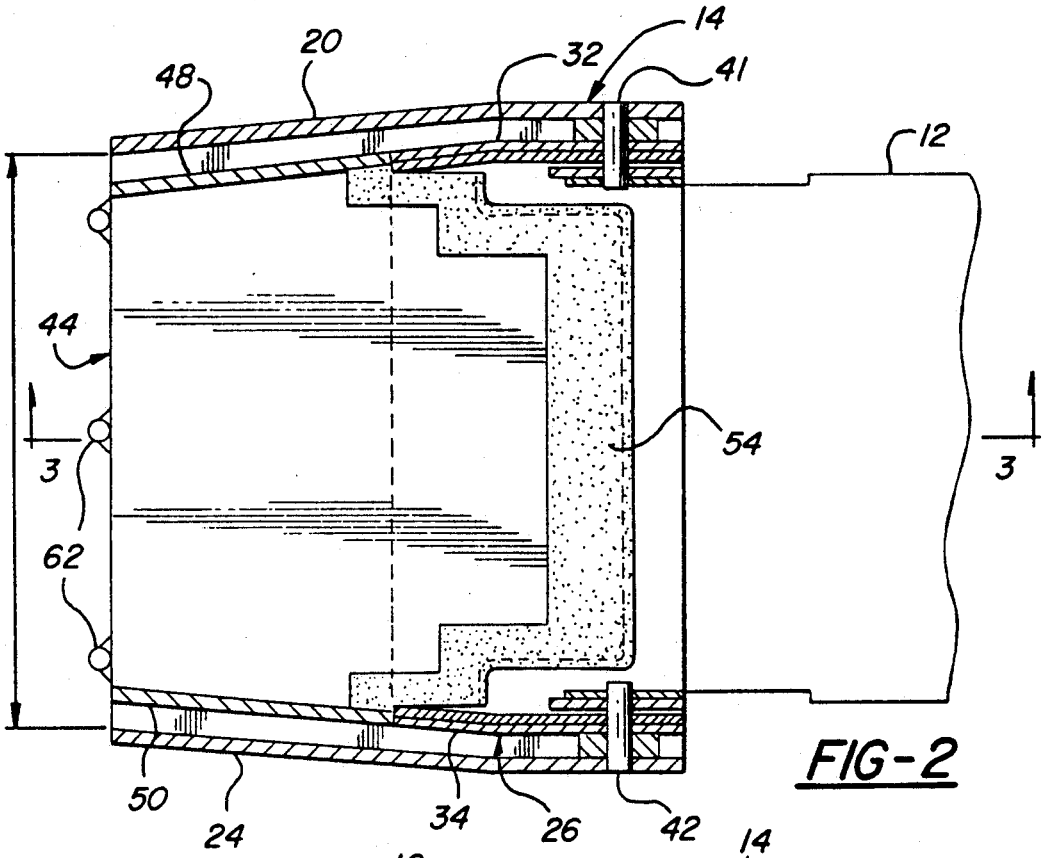
FIG. 2 is a planned view partly in section of the nozzle tip of FIG. 1.
Figure 3:
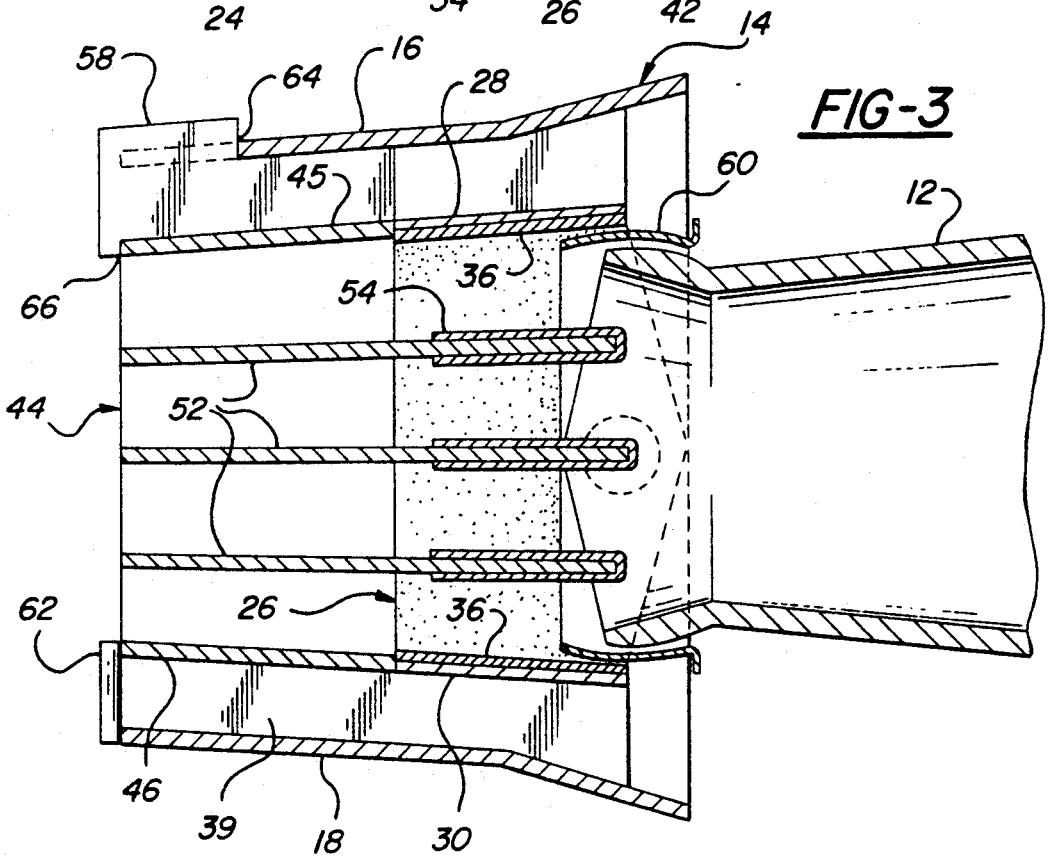
FIG. 3 is a side section view of the coal tip of FIG. 1.

FIGS. 1 through 3 illustrate in detail a first embodiment of the invention in the form of a vertically adjustable or aimable nozzle tip 10 adapted for mounting on the outlet end of a nozzle conduit 12 through which pulverized coal flows from a pulverizer. The nozzle tip comprises, in principal part, a box-like outer housing 14, an inner housing 26 and an end housing 44 which are operatively assembled to provide a nozzle tip which is heat tolerant, resistant to abrasion wear and easily repaired from inside the combustion chamber.

Outer housing 14 comprises steel top and bottom panels 16 and 18 respectively and opposing side panels 20 and 24. The outer housing preferably tapers from rear to front; in an illustrative embodiment the housing 14 is approximately 18 in. by 18 in. at the rear edge and approximately 14 in. by 14 in. at the front edge.

The inner housing 26 is also tapered and comprises steel top and bottom panels 28 and 30 and opposing side walls 32 and 34. The inside surface of the housing 26 is hardfaced; in a preferred embodiment the panels of the inner housing 26 are T-310 stainless steel faced with SA1750 CR hardfacing material 36 applied in even rows using conventional welding gun techniques.

Inner housing 26 is mounted within and in spaced relationship to the outer housing 14, the spacing vertically being determined by a plurality of parallel upper ribs 38 and lower ribs 39 which are welded to the inside surfaces of the top panel 16 and bottom panel 18 of the outer housing 14. The outer housing 14 and inner housing 26 are mounted as a unit to the outlet end of the nozzle conduit 12 by means of hinges 41 and 42 are best shown in FIG. 2. The hinges 41 and 42 permit the nozzle tip 10 to be adjusted or aimed higher or lower in the combustion chamber (not shown) for purposes of controlling the position of the fireball as earlier described. A stainless steel seal shroud 60 which conforms to the end of the conduit 12 is mounted in the back of the outer housing 14 as shown in FIG. 3 and is preferably constructed of 3/16 in. T-304 stainless steel. Holes of approximately 25/32 inches are punched through the side panels of the seal shroud 60 to accommodate the pins of hinges 41 and 42.

The end housing 44 is constructed of 310 stainless steel top and bottom panels 45 and 46 and opposing side panels 48 and 50. Again the shape of the end housing is essentially a frustum of a rectangular pyramid; i.e., this tapered from back to front to conform essentially with the inside taper of the outer housing 14. The result is a box-like structure which is closed on the top, bottom and sides but open in the axial direction; i.e., the direction of flow of pulverized coal from and through the nozzle conduit 12. This description also fits the configuration of the outer housing 14 and the inner housing 26 which are mounted as a unit on the outlet end of the conduit 12.

Welded within the end housing 44 and extending between the side walls 48 and 50 are planar splitter plates 52 preferably constructed of stainless steel. The plates 52 are mounted within the end housing 44 essentially in parallel and essentially at uniformly spaced vertical intervals to ensure an even distribution in the output flow of pulverized coal from the delivery apparatus. The upstream surfaces of the splitter plates 52 are covered with hardfacing material 54 of essentially the same character and applied in essentially the same way as the hardfacing 36 on the inside surfaces of the inner housing 26. It will be noted especially that the hardfacing 54 extends around and covers the upstream vertical edges of the splitter plates 52 as well as the upper and lower horizontal surfaces adjacent the upstream edges as best shown in FIGS. 2 and 3.

The end housing 44 is operatively mounted within the outer housing 14 as a contiguous abutting extension of the inner housing 26 as best shown in FIGS. 2 and 3; i.e., the taper angle of the end housing 44 essentially matches that of the inner housing 26 and the top bottom and side panels abut those same panels of the inner housing 26. The splitter plates 52 are approximately double the axial dimension of the end housing 44 and, therefore, extend rearwardly or upstream in the pulverized coal flow path into the inner volume of the inner housing 26.

The mechanism by which the end housing 44 is mounted to and within the confines of the outer housing 14 includes slots 56 formed in the front portion of the top panel 16 of the outer housing 14, latch keys 58 which are tack welded in place as hereinafter described and rods 62 which are also welded in place as hereinafter described. The object of the attachment mechanism is to secure the end housing 44 in the proper location to prevent inadvertent separation during use, but to do so in a "loose" or non-rigid fashion such that the expansion and contraction of the end housing 44 due to thermal phenomena can take place essentially independently of the outer housing 14 and the inner housing 26 thereby to minimize thermal stress concentrations and the fractures which normally occur as a result thereof.

To this end the end housing 44 is inserted into the outer housing 14 in the position shown in FIGS. 2 and 3 and the latchkeys 58 are thereafter inserted small end first into the slot 56 until the upper abutment reaches the end surface or edge of the top panel 16 as shown at point 64 in FIG. 3. This position may leave a small gap between the end surface of the latch key and the corresponding surface of fixed rib 38. The lower abutment contacts an holds the front edge of the end housing 44 as shown at point 66 in FIG. 3. This, however, is merely a backup as the taper of the keys provides the primary locking function. The latchkeys 58 are welded at 64 to further hold the assembly together. Rods 62 may be tack welded to the front edges of the ribs 39 to secure the bottom of the end housing 44 as shown in FIG. 3.

The construction of the nozzle tip 10 from stainless steel materials with hardfacing applied to the inner surface of the inner housing 26 and the upstream edges and horizontal surfaces of the splitter plates 52 protects the nozzle tip 10 from excessive wear due to the abrading affects of pulverized coal passing through the apparatus. The loose fit which is achieved between the end housing 44 and the outer housing 14 protects the nozzle tip from excessive stress due to thermal expansion and contraction at different rates and to different degrees as between the various components of the nozzle tip. It can further be seen that removal and replacement of the end housing 44 and the splitter plates 52 as a unit is achieved by removing the welds which secure the latchkeys 58 and the rods 62 with a carbon arc, removing latch keys 58 and simply pulling the end housing 44 forwardly into the combustion chamber. The removal and replacement of the end housing 44 and the splitter plates 52 is rapidly and easily achieved with a minimum of down time for the boiler.

Figure 4:
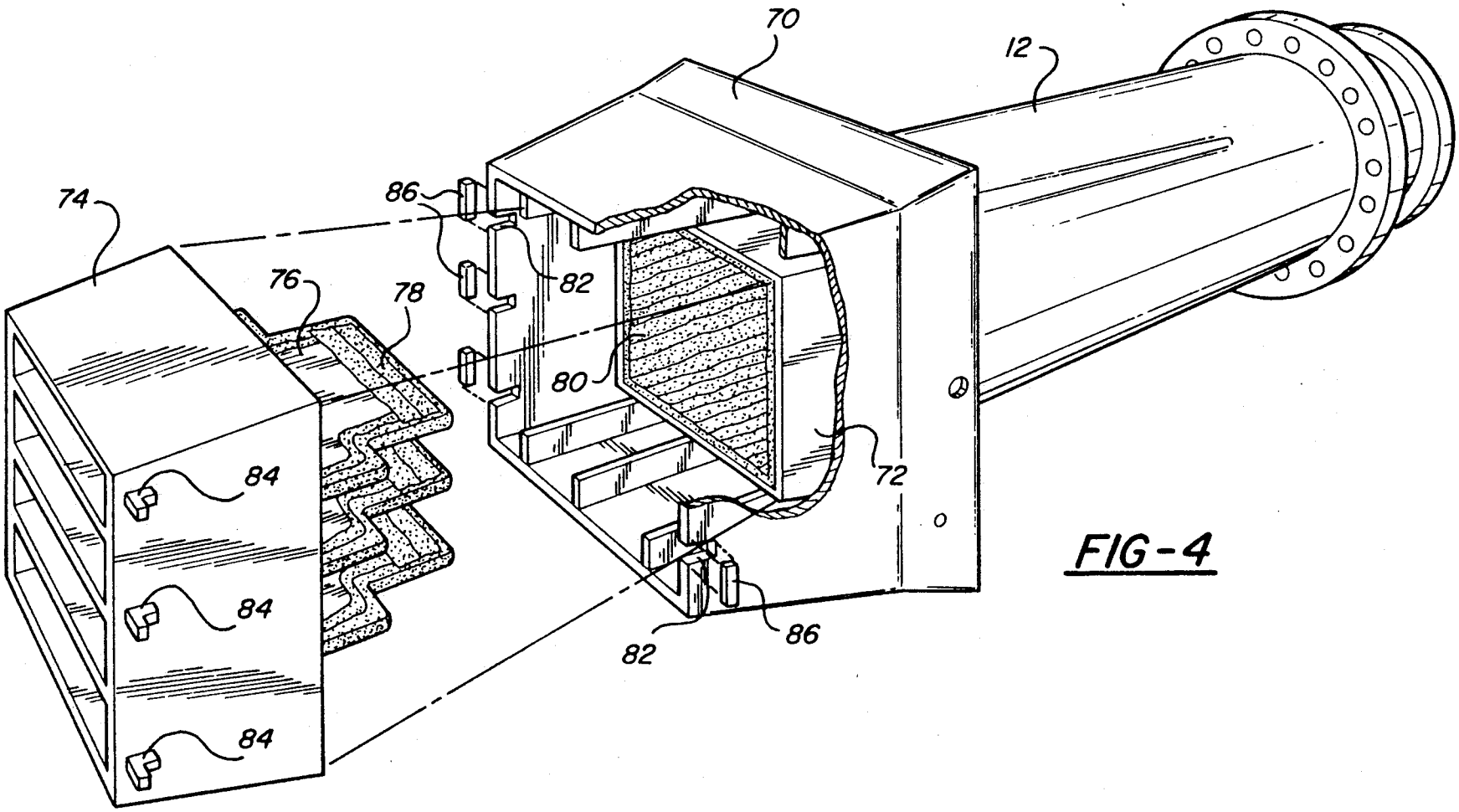
FIG. 4 is a partially exploded perspective view of a second embodiment of the invention illustrating an alternative method of securing the end housing to the outer housing.

FIG. 4 illustrates a second embodiment in which the construction and configurations of the outer housing 70, the inner housing 72 and the end housing 74 are all identical or essentially identical with the corresponding components 14, 26 and 44 of the previous embodiment. The outer housing 70 and inner housing 72 are mounted as a unit on the conduit 12 by means of pivots to permit vertical adjustment in the aiming process. The end housing 74 is fitted with splitter plates 76 which are hardfaced at 78 over the leading edges and horizontal surfaces as previously described with reference to FIGS. 1–3. Similarly, chromium based hardfacing material is applied using conventional techniques to the inner surfaces of the box-like inner housing 72 as represented by reference numeral 80.

The primary difference between the embodiment of FIG. 4 and the embodiment of FIG. 1 is the mechanism by which the end housing 74 is mounted within and to the outer housing 70 to permit thermal expansion yet to achieve an operative connection to the flow channel represented by the combination of the conduit 12 and the inner housing 72. This mechanism comprises slots 82 formed in the front edges of the side panels of the outer housing 70 which slots receive locator tabs 84 which are mounted by welding to the outside surfaces of the opposing side panels of the end housing 74 as shown in FIG. 4.

To mount the end housing 74 in place, the tabs 84 are located in the slots 82 and the unit is pushed back into the outer housing 70 until the rear edge surface of end housing 72 abuts the edge surface of the inner housing 72. Thereafter locking bars 86 are welded in place to prevent the end housing 74 from separating from the inner housing 72 during operation.

It will be apparent to those knowledgeable in the coal nozzle art that the surrounding space between the outer housings 14 and 70 of the illustrated embodiments and the inner housings 26 and 72 provides an air flow path from the atmosphere into the combustion chamber. The air which flows into the combustion chamber is combined with the pulverized coal to sustain combustion thereof and also to cool to some degree the structural components of the apparatus over which the air flows.

Various changes and modifications in the illustrated embodiments will be apparent to those skilled in the art.

I claim:

1. A projector nozzle adapted for hinged connection to the outlet end of a pulverized coal supply conduit having a longitudinal flow axis to receive and project pulverized coal into a combustion chamber comprising:

an axially open outer housing having closed top, bottom and opposing side portions;

an axially open inner housing having closed top, bottom and side portions and being disposed axially within and in spaced relationship to said outer housing;

means for hingedly mounting said outer and inner housings as a unit on said conduit adjacent said outlet end to pass coal through said inner housing;

an end housing having closed top, bottom and opposing side portions, the end housing axially open to the combustion chamber;

means for mounting said end housing within and in spaced relationship with said outer housing and in essentially contiguous, flush relationship to said inner housing to constitute an axial extension thereof; and at least one splitter plate mounted between the opposite side portions of said end housing and extending axially rearwardly into said inner housing when said end housing is in said contiguous relationship.

2. Apparatus as defined in claim 1 further including hardfacing, wear resistant material disposed over at least a portion of said splitter plate.

3. Apparatus as defined in claim 2 further including a plurality of splitter plates mounted in parallel between the opposing side portions of said end housing and extending axially rearwardly into the inner housing when said end housing is in said contiguous relationship.

4. Apparatus as defined in claim 1 wherein said means for mounting comprises a plurality of slots formed in said outer housing portions and a plurality of latch keys disposed as spacers between the said slots and said end housing and welded to at least said outer housing.

5. Apparatus as defined in claim 1 wherein said means for mounting comprises a plurality of slots formed in said outer housing portions and a plurality of locator tabs mounted on said end housing and slidable into said slots.

6. Apparatus as defined in claim 1 wherein the spacing between the inner and outer housing defines an air passage.

7. Apparatus as defined in claim further including rigid spacer means mounted on the inside surface of the bottom portion of said outer housing to receive said end housing and hold said end housing in spaced relationship to said outer housing.

8. Apparatus as defined in claim 1 wherein each of said outer and end housings tapers axially toward the discharge end.

9. Apparatus as defined in claim 1, wherein said means for mounting comprise rigid spacer means mounted on the inside surface of the bottom portion of said outer housing to receive said end housing and hold said end housing in spaced relationship to said outer housing.

10. Apparatus as defined in claim 9, wherein said means for mounting further comprise removable spacer means inserted between the top portion of the end housing and the outer housing when the end housing is secured by said rigid spacer means to further secure the end housing within the outer housing.

11. Apparatus as defined in claim 10, wherein the removable spacer means are additionally welded to at least the outer housing.

12. Apparatus as defined in claim 10, wherein the rigid spacer means comprise a plurality of support ribs on the inside surface of the bottom portion of the outer housing, the support ribs parallel to the taper of the end housing to mate essentially flush with the bottom portion of the end housing when the end housing is inserted in the outer housing.

13. Apparatus as defined in claim 12, wherein the top portion of the end housing is spaced from the top portion of the outer housing when the end housing is resting on the support ribs.

14. Apparatus as defined in claim 13, wherein the removable spacer means comprise latch keys which mate essentially flush with the top portion of the end housing and the top portion of the outer housing when inserted therebetween.

15. Apparatus as defined in claim 14, wherein said latch keys include a short axial stop abutting the discharge end of the end housing when the latch key is inserted between the outer and end housings.

16. Apparatus as defined in claim 14, wherein the latch keys include an enlarged upper abutment portion mating with slots in the outer housing to axially limit the distance the latch keys are inserted between the outer and end housings.

17. Apparatus as defined in claim 1, wherein the interior surfaces of the top, bottom and side portions of the inner housing include a layer of hardfacing material.

18. Apparatus as defined in claim 17, wherein the planes of the hard facing material on the interior surfaces of the inner housing lie above the interior surfaces of the end housing when the end housing and the inner housing are in their essentially contiguous, flush relationship.

* * * * *

UNITED STATES PATENT AND TRADEMARK OFFICE

CERTIFICATE OF CORRECTION

PATENT NO. : 5,215,259

DATED : June 1, 1993

INVENTOR(S) : Rickey E. Wark

It is certified that error appears in the above-identified patent and that said Letters Patent is hereby corrected as shown below:

Column 1, Line 41, Delete "520,739" Insert --4,520,739--

Column 4, Line 19, Delete "top bottom" Insert --top, bottom--

Column 4, Line 49, Delete "an" Insert --and--

Column 6, Line 9, Delete "opposite" Insert --opposing--

Column 6, Line 35, Delete "claim further" Insert --claim 1 further

Signed and Sealed this

First Day of February, 1994

Bruce Lehman

*Attest:*

BRUCE LEHMAN

*Attesting Officer*

*Commissioner of Patents and Trademarks*